US009567840B2

(12) United States Patent
Parker et al.

(10) Patent No.: US 9,567,840 B2
(45) Date of Patent: Feb. 14, 2017

(54) METHOD AND DEVICE FOR STIMULATING A TREATMENT ZONE NEAR A WELLBORE AREA OF A SUBTERRANEAN FORMATION

(71) Applicant: BLUE SPARK ENERGY INC., Calgary (CA)

(72) Inventors: Todd Parker, Calgary (CA); Shawn Carroll, Calgary (CA); Dan Skibinski, Calgary (CA)

(73) Assignee: BLUE SPARK ENERGY INC., Calgary (CA)

( * ) Notice: Subject to any disclaimer, the term of this patent is extended or adjusted under 35 U.S.C. 154(b) by 0 days.

(21) Appl. No.: 14/697,479

(22) Filed: Apr. 27, 2015

(65) Prior Publication Data

US 2015/0308251 A1 Oct. 29, 2015

Related U.S. Application Data

(60) Provisional application No. 61/985,258, filed on Apr. 28, 2014.

(51) Int. Cl.
*E21B 43/26* (2006.01)

(52) U.S. Cl.
CPC ..... *E21B 43/26* (2013.01)

(58) Field of Classification Search
None
See application file for complete search history.

(56) References Cited

U.S. PATENT DOCUMENTS

| | | | | |
|---|---|---|---|---|
| 4,084,638 | A * | 4/1978 | Whiting | E21B 43/003 166/248 |
| 4,252,210 | A * | 2/1981 | Sodich | G01V 1/135 175/1 |
| 4,345,650 | A * | 8/1982 | Wesley | E21B 36/04 166/177.2 |
| 5,058,678 | A * | 10/1991 | Dill | C09K 8/528 166/279 |
| 6,227,293 | B1 * | 5/2001 | Huffman | E21B 28/00 166/177.2 |
| 2011/0139441 | A1 * | 6/2011 | Zolezzi Garreton | E21B 28/00 166/249 |
| 2013/0146281 | A1 * | 6/2013 | Noui-Mehidi | E21B 43/26 166/249 |
| 2014/0374107 | A1 * | 12/2014 | Reyes | C09K 8/72 166/307 |

* cited by examiner

*Primary Examiner* — Angela M DiTrani
*Assistant Examiner* — Anuradha Ahuja
(74) *Attorney, Agent, or Firm* — Klein, O'Neill & Singh, LLP

(57) ABSTRACT

The invention concerns a method for stimulating a treatment zone near a wellbore area in fluid connection with at least one porous zone of a subterranean formation, said method comprising the steps of generating (S1*a*) at least one electrical discharge in said wellbore at a distance from the at least one porous zone in order to propagate at least one shock wave adapted to fracture said treatment zone and introducing (S2*a*) a chemical agent within said treatment zone for increasing the permeability of said treatment zone.

19 Claims, 5 Drawing Sheets

METHOD AND DEVICE FOR STIMULATING A TREATMENT ZONE NEAR A WELLBORE AREA OF A SUBTERRANEAN FORMATION

FIELD OF ART

The field of the invention relates to the stimulation of a subterranean formation and, more particularly, to a method and device for improving the recovery of hydrocarbons in a wellbore from at least one porous zone of a subterranean formation.

BACKGROUND

Several techniques exist in order to retrieve a fluid, such as e.g. oil or gas, from a subterranean formation. These techniques are mainly classified into primary, secondary and tertiary production methods.

Pressure is the key when collecting oil from the natural underground subterranean formations in which it forms. When a well is drilled, the pressure inside the formation pushes the oil deposits from the fissures and pores where it collects and into the wellbore where it can be recovered. Primary production methods consist in extracting the fluid using the natural flow or an artificial lift. However, the initial pressure of the oil is finite.

Secondary oil recovery is employed when the pressure inside the well drops to levels that make primary recovery no longer viable. Secondary recovery techniques involve injection of fluids or gas to increase reservoir pressure, or the use of artificial lift. However, these techniques allow only recovering around one third of the oil before the cost of producing becomes higher than the price the market would pay.

Tertiary production methods also called Enhanced Oil Recovery (EOR) may be performed on a well to increase or restore production.

EOR uses sophisticated techniques that may actually be initiated at any time during the productive life of an oil reservoir. Its purpose is not only to restore formation pressure, but also to improve oil displacement or fluid flow in the reservoir. Three common types of EOR operations are chemical flooding (alkaline flooding or micellar-polymer flooding), miscible displacement (carbon dioxide injection or hydrocarbon injection), and thermal recovery (steamflood or in-situ combustion).

Stimulation consists of increasing permeability of the oil or gas remaining in the subterranean formation, thereby facilitating the flow of hydrocarbonaceous fluids into the well from the subterranean formation. Stimulation may be employed to start production from a reservoir when a well has initially low permeability or to further increase permeability and flow from an already existing well that has become under-productive.

One common stimulation method consists in injecting a chemical agent, e.g. an acid composition, into the subterranean formation. Such techniques, called "acidizing techniques", may be carried out as "matrix acidizing" procedures or as "acid-fracturing" procedures.

In acid fracturing, the acidizing composition is injected within the wellbore under sufficient pressure to cause fractures to form within the subterranean formation and trigger a chemical reaction that increase the permeability of the oil within the subterranean formation. Such a fracturing requires the injection of the acid composition under high pressure, which may be complex, costly and/or inefficient.

In matrix acidizing, the acidizing fluid is passed into the formation from the well at a pressure below the fracturing pressure of the formation. In this case, the permeability increase is caused primarily by the chemical reaction of the acid within the formation with little or no permeability increase being due to mechanical disruptions within the subterranean formation as in fracturing.

A common difficulty encountered in acidizing relates to the rapid reaction rate of the acidizing composition with those portions of the formation with which it first comes into contact. This is particularly the case in matrix acidizing. As the acidizing composition is introduced into the wellbore, the acid reacts rapidly with the material immediately adjacent to the wellbore. Thus, the acid is "spent" before it can penetrate a significant distance into the subterranean formation. For example, in matrix acidizing of a limestone formation, it is common to achieve maximum penetration with a live acid to a depth of only a few inches to a foot from the face of the wellbore. This, of course, severely limits the increase in productivity of the well.

Various methods have been attempted to reduce the reaction rate of the acid with the rock formation. For example, reaction inhibitors may be added to the acid composition. Additionally, the local temperature in the wellbore may be reduced in order to slow down the reaction rate of the acid fluid. However, all of these solutions suffer serious drawbacks by increasing the cost and complexity of the matrix acidizing operation. Therefore, it would be advantageous to have a method and a device that provides for an improved deep acid stimulation over those known heretofore.

SUMMARY

The present invention concerns a method for stimulating a treatment zone near a wellbore area in fluid connection with at least one porous zone of a subterranean formation, said method comprising the steps of:

generating at least one electrical discharge in said wellbore at a distance from the at least one porous zone in order to propagate at least one shock wave adapted to fracture said treatment zone; and introducing a chemical agent within said treatment zone for increasing the permeability of said treatment zone.

The shock wave generated by the electrical discharge fractures the porous zone, increasing the area of contact with the chemical agent and thus making the stimulation more effective.

In the stimulation method according to the invention, the combination of shock wave fracturing substantially simultaneously, preceding or followed by chemical agent stimulation enhances dramatically the mobility of previously immobile hydrocarbons stored in the porous zone for producing said mobilized hydrocarbons from the wellbore, improving therefore the effectiveness of the hydrocarbon recovery.

Furthermore, shock wave fracturing does not require pressure greater than the fracture gradient pressure advantageously reducing cost, complexity and time of operation. Similarly, injecting a chemical agent in a fractured porous zone, e.g. using a jet injection method, increases rapidly and efficiently the permeability of the hydrocarbons of the porous zone, advantageously also reducing cost, complexity and time of operation.

In a first embodiment of the method according to the invention, the step of generating an electrical discharge is performed prior to the step of introducing the chemical agent. This allows the shock wave to fracture the porous zone before the chemical agent is introduced, increasing therefore the surface of contact of the chemical agent, improving thus the effectiveness of the method.

In a second embodiment of the method according to the invention, the step of introducing a chemical agent is performed prior to the step of generating an electrical discharge, allowing therefore a deeper penetration of the chemical agent to be drived further by the shock wave effect, improving thus the effectiveness of the method.

In a third embodiment of the method according to the invention, the step of generating an electrical discharge and the step of introducing a chemical agent are performed simultaneously, allowing thus the method to be carried out faster and with improved effectiveness.

Preferably, the shock wave propagates radially from the longitudinal axis of the wellbore and/or the chemical agent is introduced preferentially into the newly created fractures.

In another embodiment, the shock wave propagates in a predetermined direction and/or the chemical agent is introduced toward a predetermined direction.

Preferably, a series of shock waves is propagated. For example, a series of at least ten shock waves may be propagated, e.g. at a periodic interval of time, for example every 5 to 20 seconds. A plurality of series may be advantageously repeated at different locations in the wellbore.

In a preferred embodiment according to the invention, the electrical discharge is generated in a liquid that propagates the shock wave.

According to an embodiment, the chemical agent is any composition, which may improve hydrocarbon recovery when added to the wellbore such as e.g. a composition comprising an acid, a miscible fluid or a polymer.

An acid reacts with the mineral constituents of the subterranean formation in order to increase the permeability of the hydrocarbons of the porous zone. The use of a shock wave generated by an electrical discharge in combination with an acid composition allows increasing dramatically the depth of penetration of the acid throughout the targeted porous zone of the subterranean formation.

Moreover, the method does not require introducing the acid composition in excess of the fracture gradient pressure of the subterranean formation. Although potentially useful as a hydraulic fracturing or "fracking" fluid, the acid composition useful for deep acid stimulation is operable to permit diffusion of the acid into the subterranean formation through the wellbore wall using fluid transport and diffusion mechanics. Furthermore, with the method according to the invention, there is no need to introduce an externally supplied surfactant.

In an embodiment of the method according to the invention, the acid composition is introduced at a static pressure less than the fracture gradient pressure value of the subterranean formation.

Preferably, the acid is a weak acid. A weak acid has a reaction rate with the mineral constituents of the subterranean formation that is lower than the rate of diffusion through the subterranean formation. Using such a weak acid can prevent all the acid being consumed upon introduction to the wellbore wall surface.

Advantageously, the acid may be introduced in the form of a gel or foam in order to avoid the acid to react too quickly upon initial application to the wellbore wall. This allows maximizing the distance of diffusion through the subterranean formation, which improves the quality of the stimulation per treatment, instead of simply acidizing the surface of the wellbore wall with the entire amount of applied acid.

In an embodiment of the method according to the invention, a significant portion of the acid prevents reacting with the subterranean formation until the acid is diffused into the subterranean formation by the propagation of the at least one shock wave. In an embodiment of the method, a "significant portion" means at least 50% of the acid introduced with the acid composition. In an embodiment, a significant portion means at least 60% of the acid introduced. In an embodiment, a significant portion means at least 70% of the acid introduced. In an embodiment, a significant portion means at least 80% of the acid introduced. In an embodiment, a significant portion means at least 90% of the acid introduced. In an embodiment, a significant portion means at least 95% of the acid introduced. As this significant portion decreases with time, the propagation of the at least one shock wave is preferably performed when at least 50% of the introduced acid remains. For example, the propagation of the at least one shock wave is preferably performed within a few hours, e.g. 24, preferably 12 hours, after acid introduction.

The difference in depth between initial acid penetration depth and the subsequent acid penetration depth depends on several factors, including the energy and frequency of the shock waves, time between generation of the at least one electrical discharge and the introduction of the chemical agent (e.g. simultaneous or up to several days), time of exposure to shock waves (e.g. few hours), the type of chemical agent and the composition of the subterranean formation.

The invention also concerns a stimulating device for recovering hydrocarbons in a wellbore from at least one porous zone of a subterranean formation, said device comprising:

a electrical discharge generating unit configured for generating at least one electrical discharge in said wellbore at a distance from the at least one porous zone in order to propagate at least one shock wave for fracturing said at least one porous zone; and a chemical agent introducing unit configured for introducing a chemical agent within said at least one porous zone for increasing the permeability of said hydrocarbons.

A unique tool comprising an electrical discharge generating unit and a chemical agent introducing unit allows advantageously recovering quicker hydrocarbons in the wellbore.

In an embodiment of the device according to the invention, the electrical discharge unit comprises a first electrode and a second electrode for generating the at least one electrical discharge that propagates the at least one shock wave.

In a preferred embodiment, the electrical discharge unit comprises a membrane (or sleeve) delimiting partially a chamber which is at least partially filled with a shock wave transmitting liquid.

Such a membrane isolates the liquid in the chamber from elements of the wellbore surrounding the stimulating device, such as e.g. mud, acid or other fluids, while maintaining coupling the shock wave with the formation. Such a flexible membrane prevents the acid composition from damaging electrodes and other components (insulators) of the electrical discharge unit.

Preferably, the membrane is deformable and/or flexible and/or elastic in order to conduct efficiently the shock wave into the formation.

In an embodiment according to the invention, the membrane is made of fluorinated rubber or other fluoroelastomer to propagate shock waves efficiently toward the openings.

In an embodiment according to the invention, the relative deformation of the membrane (25) is at least 150%, preferably at least 200%.

The electrical discharge generating unit may be mounted above or under the chemical agent introducing unit.

The electrical discharge generating unit and the chemical agent introducing unit may be configured to work simultaneously or alternatively.

For example, when the electrical discharge is to be performed before the introduction of the chemical agent, the electrical discharge generating unit may be mounted under the chemical agent introducing unit and both the electrical discharge generating unit and the chemical agent introducing unit may work simultaneously as the stimulating device goes down the wellbore, preferably at a constant speed, allowing the stimulating process to be carried out quickly, e.g. in a few hours.

BRIEF DESCRIPTION OF THE DRAWINGS

These and other features, aspects, and advantages of the present invention are better understood with regard to the following Detailed Description of the Preferred Embodiments, appended Claims, and accompanying Figures, where:

Figure 1:
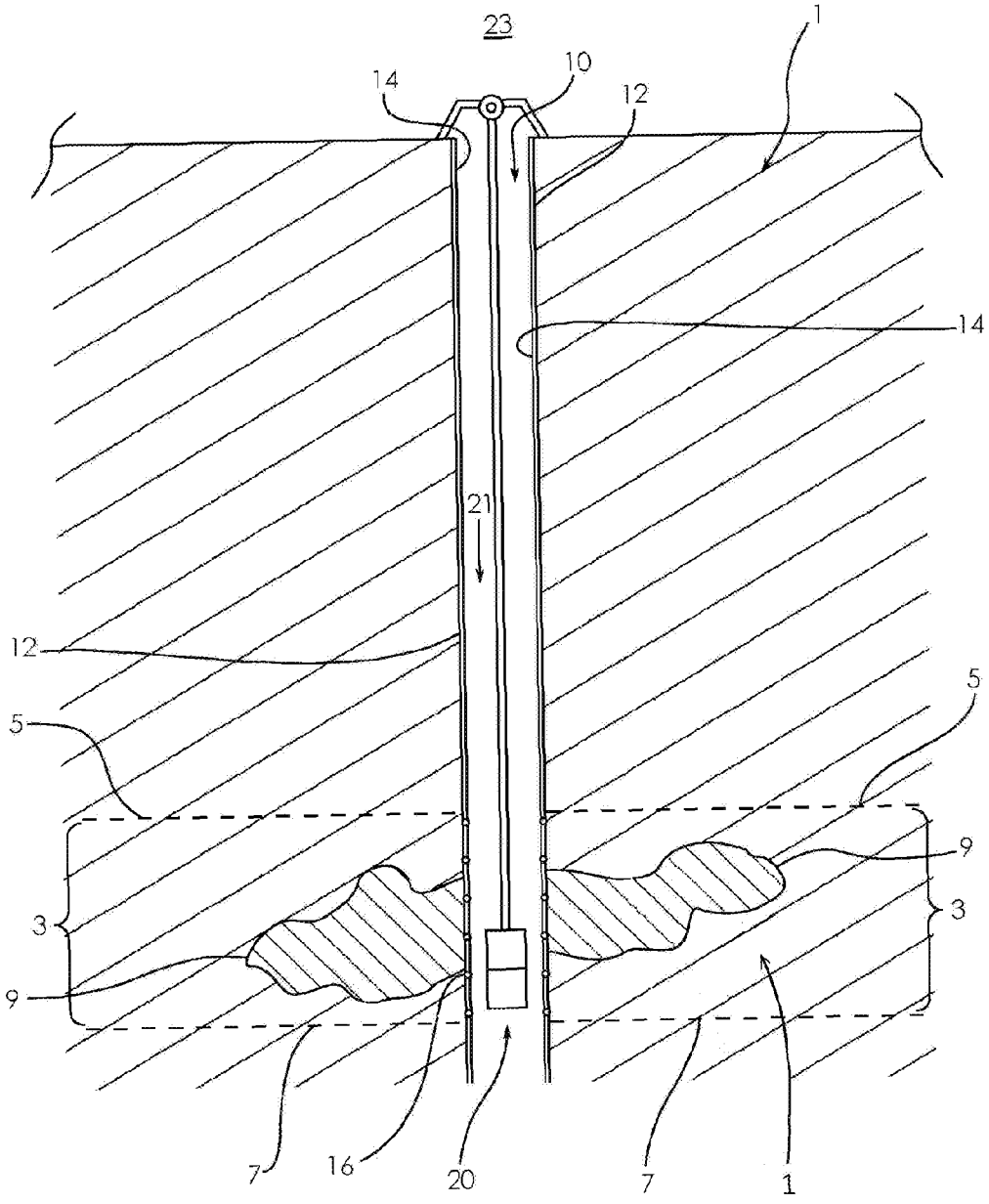
FIG. 1 illustrates a cross-sectional view of a pre-formed wellbore comprising an embodiment of a stimulation device according to the invention.

In the accompanying Figures, similar components or features, or both, may have the same or a similar reference label.

DETAILED DESCRIPTION

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification.

Those of skill in the art understand that the invention is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur. "Operable" and its various forms means fit for its proper functioning and able to be used for its intended use.

Spatial terms describe the relative position of an object or a group of objects relative to another object or group of objects. The spatial relationships apply along vertical and horizontal axes. Orientation and relational words including "uphole" and "downhole"; "above" and "below"; "up" and "down" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The invention encompasses and bounds smaller ranges of the interval subject to any specific exclusion provided.

Where the Specification and appended Claims reference a method comprising two or more defined steps, the defined steps can be carried out in any order or simultaneously except where the context excludes that possibility.

FIG. 1 shows a subterranean formation 1 comprising a treatment zone 3. For example, such a treatment zone 3 may be made of rock. Treatment zone 3 has an upper bound 5 and a bottom bound 7.

In this example, the treatment zone 3 comprises a plurality of porous zones each being a portion of the subterranean formation 1 to be treated. Porous zones 9 constitute reservoirs of hydrocarbons such as oil or gas.

The subterranean formation 1 and the treatment zone 3 are accessible through a wellbore 10. The wellbore 10 extends from the surface downward to the treatment zone 3. The treatment zone 3 interfaces with the wellbore 10 at wellbore wall 12 and extends radially from wellbore 10. In this example, the wellbore 10 is vertical, but this does not limit the scope of the present invention as the method and device according to the invention may advantageously be used in any type of wellbores such as e.g. horizontal wellbores.

The uphole bound 5 is the uphole-most portion of treatment zone 3 accessible through wellbore 10 and the downhole bound 7 is the downhole-most portion of treatment zone 3 accessible through wellbore 10.

Wellbore 10 is defined by wellbore wall 12. In the example illustrated on FIG. 1, this wall 12 comprises a metallic casing 14. This metallic casing 14 comprises perforations 16 that allow creating some flow paths within the treatment zone 3 adjacent to the wellbore 10.

A source of electrohydraulic energy in the form of a stimulating device 20 is introduced (arrow 21) into the wellbore 10 and positioned near the wellbore wall 12.

Figure 2:
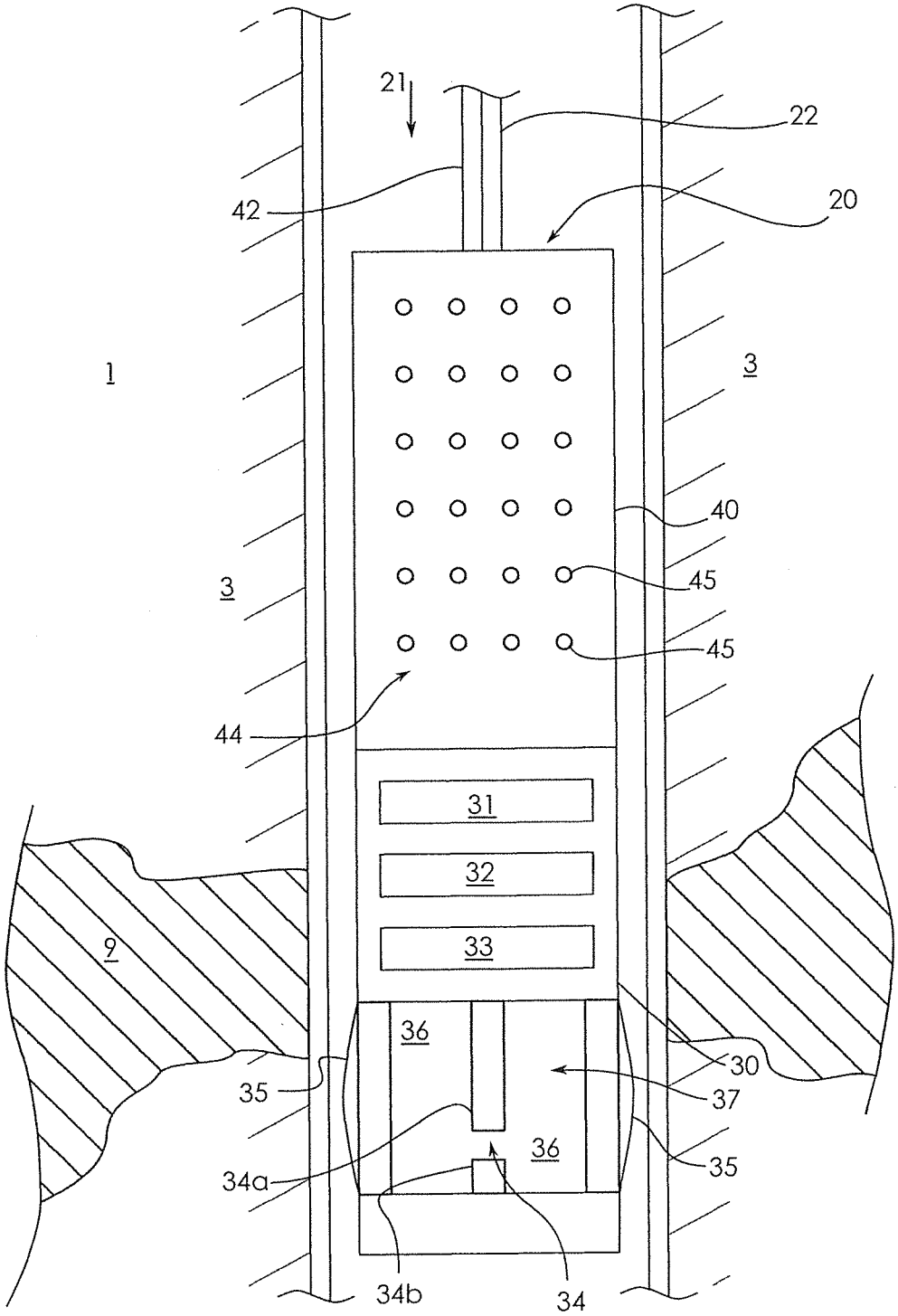
FIG. 2 illustrates an example of fracturing using the stimulation device according to the invention.

FIG. 2 illustrates a preferred embodiment of the stimulating device 20 according to the invention, wherein the stimulating device 20 is a unique tool. The stimulating device 20 is coupled to a wireline 22 which is operable to supply power from the surface 23 to the stimulating device 20.

The stimulating device 20 comprises an electrical discharge generating unit 30 and a chemical agent introducing unit 40 that allow advantageously recovering more hydrocarbons from the porous zones 9 into the wellbore 10.

In another embodiment of the device according to the invention, the electrical discharge generating unit 30 and the chemical agent introducing unit 40 may be two separated tools.

In the example illustrated in FIG. 2, the electrical discharge generating unit 30 is mounted under the chemical agent introducing unit 40. The electrical discharge generating unit 30 and the chemical agent introducing unit 40 may be independent sections of the stimulating device 20 and may be, for example, rotatable. Moreover, the electrical discharge generating unit 30 and the chemical agent introducing unit 40 may be configured to work simultaneously or in sequence. This allows for example, when the electrical discharge is to be performed before the introduction of the chemical agent, the electrical discharge generating unit 30 and the chemical agent introducing unit 40 to work simultaneously as the stimulating device 20 goes down the wellbore 10, preferably at a constant speed, allowing the stimulating method to be carried out quickly, e.g. in a few hours.

The electrical discharge generating unit 30 is configured for generating one or several electrical discharges in the wellbore 10 at a distance from the porous zones 9 in order to propagate one or several shock waves within said porous zones 9.

The electrical discharge generating unit 30 may be configured to propagate shock waves radially or in a predetermined direction.

In this example, and as already describes in U.S. Pat. No. 4,345,650 issued to Wesley or U.S. Pat. No. 6,227,293 issued to Huffman, incorporated hereby by reference, the electrical discharge generating unit 30 comprises a power conversion unit 31, a power storage unit 32, a discharge control unit 33 and a discharge system 34. The discharge system 34 comprises a first electrode 34*a* and a second electrode 34*b* configured for triggering an electrical discharge.

The discharge system 34 comprises a plurality of capacitors (not represented) for storage of electrical energy configured for generating one or a plurality of electrical discharges into the shock wave transmitting liquid 37.

Electrical power is supplied at a steady and relatively low power from the surface through the wireline 22 to the downhole stimulating device 20 and the power conversion unit 31 comprises suitable circuitry for charging of the capacitors in the power storage unit 32. Timing of the discharge of the energy in the power from the power storage unit 32 through the discharge system 34 is accomplished using the discharge control unit 33.

In a preferred embodiment, the discharge control unit 33 for example is a switch, which discharges when the voltage reaches a predefined threshold. Upon discharge of the capacitors in the power storage section through the first electrodes 34*a* and the second electrode 34*b* of the discharge control unit 33, electrohydraulic shock waves 50 (in reference to FIG. 3) are transmitted into the subterranean formation 1. Other designs of discharge unit 34 are disclosed in U.S. Pat. No. 6,227,293 issued to Huffman which is included hereby reference. Other embodiments also known can be implemented.

Still in reference to FIG. 2, the electrical discharge unit 30 comprises a membrane (or sleeve) 35 partially defining a chamber 36 around the discharge system 34 and which is fulfilled with a shock wave transmitting liquid 37 that allows transmitting shock waves through the membrane 35 into the subterranean formation 1. According to the electrohydraulic effect, an electrical discharge is discharged in a very short time (few micro seconds for example) in the shock wave transmitting liquid 37.

Such a membrane 35 isolates the liquid 37 in the chamber 36 from the wellbore 10 while maintaining acoustic coupling with the formation 1, allowing advantageously the simultaneous use of the electrical discharge generating unit 30 and the chemical agent introducing unit 40 while preventing the acid composition from damaging the first electrode 34*a* and the second electrode 34*b* and other components (insulators) of the electrical discharge unit 34.

The membrane 35 must be deformable. The flexibility of the membrane 35 deforms allowing therefore an efficient conduction of the shock wave into the formation for fracturing the porous zones 9.

Figure 3:
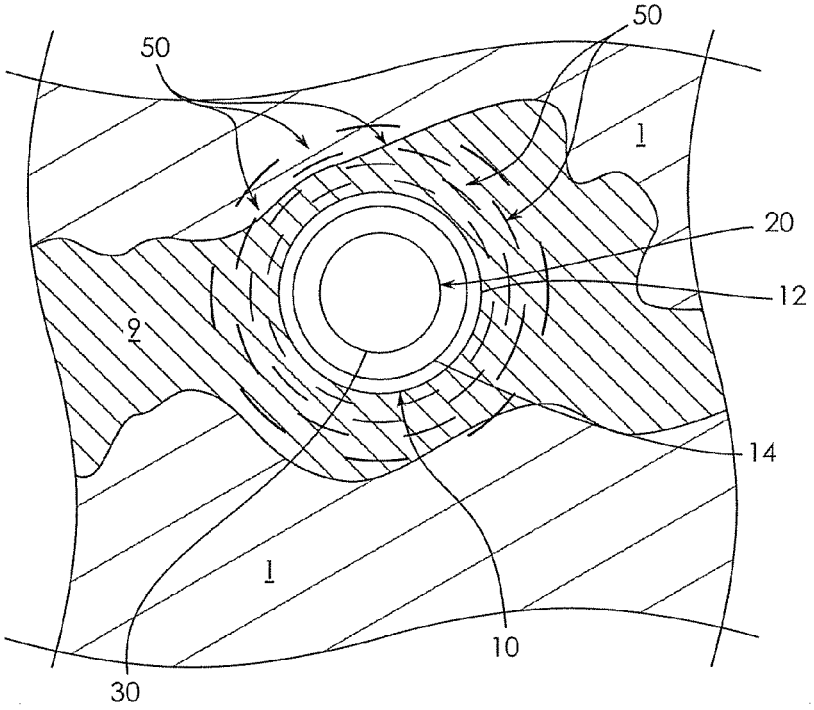
FIG. 3 illustrates an example of result of the fracturing of FIG. 2.
Figure 4:
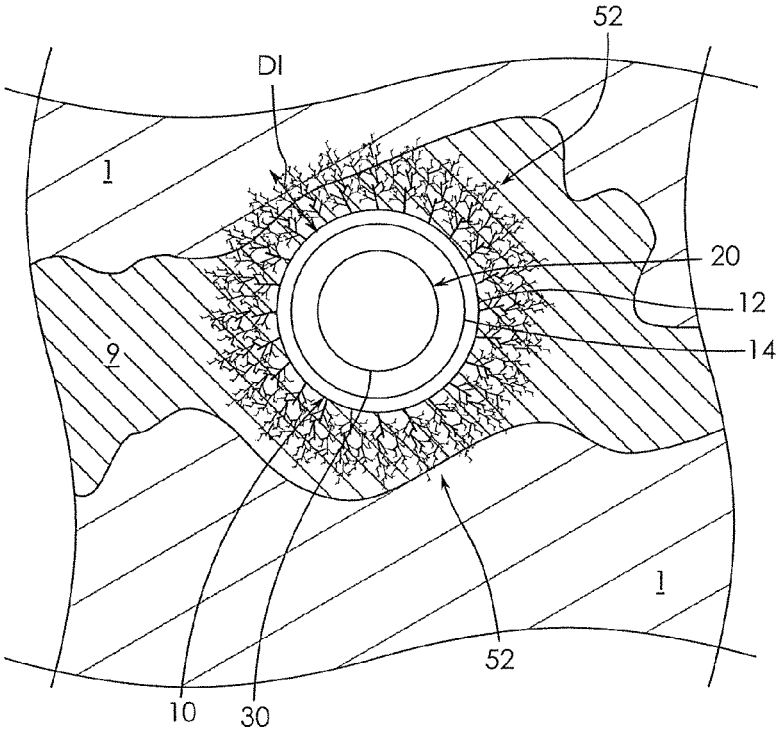
FIG. 4 illustrates an example of fracturing using the stimulation device according to the invention.

FIGS. 3 and 4 illustrate the operation of the electrical discharge generating unit 30. The electrical discharge generating unit 30 generates electrohydraulic shock waves 50 which propagate radially, via the shock wave transmitting liquid 37, into the near wellbore area. These shock waves induce a number of micro fractures 52 into a portion of the subterranean formation 1, on a depth D1 between 0.1 and 0.5 meter all around the wellbore. These micro fractures 52 increase the contact area of the paths between the treatment zone 3 and the wellbore 10.

The chemical agent introducing unit 40 is configured for introducing a chemical agent within the porous zone 9 for increasing the permeability of said treatment zone. The permeability is the ability or measurement of a rock's ability to transmit fluids or gases. The chemical agent introducing unit 40 may be configured to introduce the chemical agent radially or in a predetermined direction.

In the example described hereunder, the chemical agent is a composition comprising an acid. This does not limit the scope of the present invention as the chemical agent may be, for example, a miscible fluid (such as e.g. CO2) or a polymer.

As described in FIG. 2, the chemical agent introducing unit 40 is coupled to a coiled tubing 42, which is operable to supply the acid composition 43 (in reference to FIG. 5) and power from the surface to the chemical agent introducing unit 40.

The acid composition is introduced to treatment zone 3 through an acid delivery system 44, which comprises acid flow channels 45, which are operable to direct the acid composition onto the wellbore wall 12 in treatment zone 3.

Figure 5:
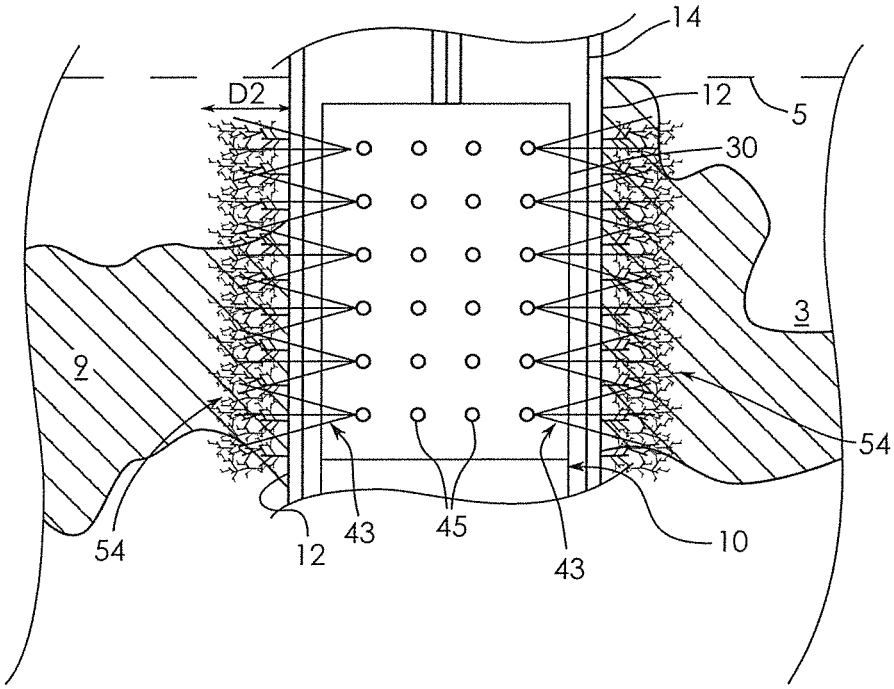
FIG. 5 illustrates an embodiment of a stimulation device according to the invention.

FIG. 5 shows the chemical agent introducing unit 40 introduces an acid composition 43 by jets to treatment zone 3 through acid flow channels 45. In this example, the acid composition is introduced radially onto the wellbore wall 12 from uphole bound 5 to downhole bound 7 of treatment zone 3.

The acid composition 43 coats the wellbore wall 12 where distributed and allows the acid from the acid composition 43 to diffuse and penetrate into the treatment zone 3, forming an acid treated portion 54 of the treatment zone 3.

The acid penetrates into treatment zone 3 to initial acid penetration depth D2, which is the depth into subterranean formation 1 as measured from wellbore wall 12.

Diluted hydrochloric and sulfuric acids are useful examples of acids solutions for the acid composition. Preferably, the acid has a pH value in a range of from about 2 to about 5. A number of different acids are used in conventional acidizing treatments. The most common are hydrochloric (HCl), hydrofluoric (HF), acetic (CH3COOH), formic (HCOOH), sulfamic (H2NSO3H) or chloroacetic (ClCH2COOH).

The acid of the composition 43 may advantageously be a weak acid. Weak acids are acids that do not fully disassociate in the presence of water. Acetic acid, formic acid, fluoroboric acid and ethylenediaminetetraacetic acid (EDTA) are examples of useful weak acids. Weak acids are considered useful in that their reaction is not instantaneous and total with the minerals present in the formation upon contact but rather measured through known reaction constants, permitting application of electrohydraulic energy.

The acid composition as part of an applied gel or foam can prolong contact with the wellbore wall 12. The gel or foam can also reduce the amount of the acid composition that directly contacts the wellbore wall 12, which increases the amount of unreacted acid composition available for driving into the treatment zone 3 using electrohydraulic energy.

The foam or gel can also improve the locating of the acid composition as the foam or gel adheres to the wellbore wall 12 proximate to where it is distributed. An embodiment of the method includes where the acid composition is part of a gel that is operable to physically adhere to the wellbore wall 12. An embodiment of the method includes where the acid composition is part of a foam that is operable to physically adhere to the wellbore wall 12. Pressurized gases, including nitrogen, air and carbon dioxide, are useful for creating a foam to carry the acid composition.

According the invention, the chemical agent introducing unit 40 is used on the same zone as the one treated by electrohydraulic shock wave pulses. The chemical agent introducing unit 40 introduces acid composition 43 radially into the treatment zone 3 from uphole bound 5 to downhole bound 7 of treatment zone 3. The stimulating device 20 may be moved in the wellbore 10 to treat the formation 1 at different position.

Examples of Operation

Figure 6:
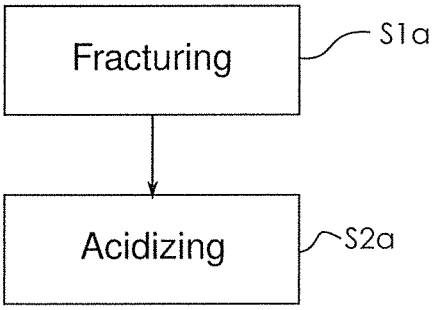
FIG. 6 illustrates a first embodiment of the method according to the invention.

FIG. 6 illustrates a first embodiment of the method according to the invention, wherein the step S2*a* of acidizing is performed after the step S1*a* of shock wave fracturing. In this case, in reference to FIGS. 4 and 5, the acid composition 43 fills the micro fractures 52. The contact area between the acid composition 43 and the micro fractures 52 of the treatment zone 3 is increased by a factor 5, increasing the efficiency of the acidizing.

Figure 7:
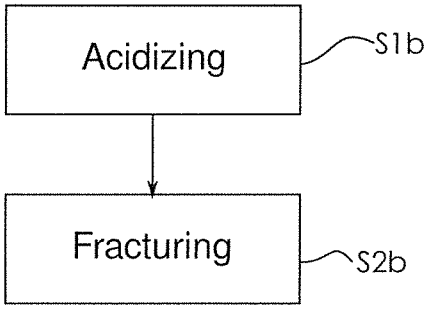
FIG. 7 illustrates a second embodiment of the method according to the invention.

FIG. 7 illustrates a second embodiment of the method according to the invention, wherein the step S1*b* of acidizing is performed before the step S2*b* of shock wave fracturing. In this case, in reference to FIGS. 3, 4 and 5, the shock waves 50 push the acid composition 43 into the porous zones while creating the micro fractures 52.

Figure 8:
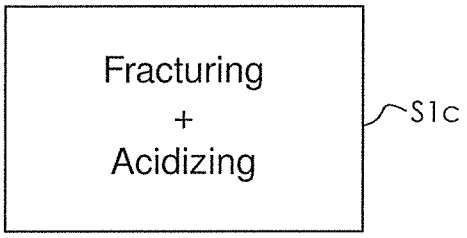
FIG. 8 illustrates a third embodiment of the method according to the invention.

FIG. 8 illustrates a third embodiment of the method according to the invention, wherein acidizing and shock wave fracturing are performed in a single step S1*c*. In this case, in reference to FIGS. 3, 4 and 5, the acid composition 43 is introduced at the same time as the micro fractures 52 are formed.

Supplemental Equipment

Embodiments include many additional standard components or equipment that enables and makes operable the described apparatus, process, method and system.

Operation, control and performance of portions of or entire steps of a process or method can occur through human interaction, pre-programmed computer control and response systems, or combinations thereof.

Experiment

Examples of specific embodiments facilitate a better understanding of stimulation method. In no way should the Examples limit or define the scope of the invention.

This method shows good results and the difference in contact area between the initial acid penetration and the treatment zone with or without propagation of shock waves is at least 500% greater.

Figure 9:
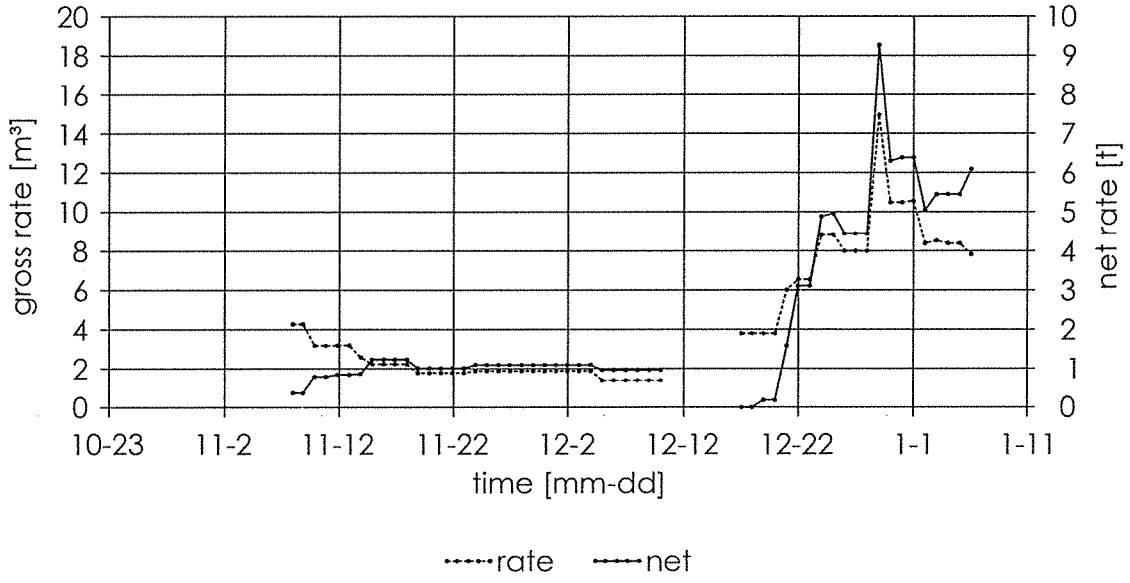
FIG. 9 shows the histogram depth analysis for both before and after shock wave and acid exposure.

FIG. 9 describes an example of results wherein shock waves are first propagated within a calcareous sandstone formation of porosity of 15%, permeability of 7.3-10.2 mD.

Prior propagating shock waves or acidizing (i.e. before November 8), net production of the wellbore was 0.5 t (3.5 Barrels of Oil Per Day ("BOPD")). After shock waves propagation on a treatment zone using the stimulating device according to the invention between November 8 and December 10, net production increases up to 1.0 t (7.3 BOPD). Then, after acidizing the same treatment zone using the stimulating device according to the invention between December 17 and January 6, net production reaches 5.5 t (40 BOPD).

The invention claimed is:

1. A method for stimulating a treatment zone near a wellbore area in fluid connection with at least one porous zone of a subterranean formation, said method comprising the steps of:

generating at least one electrical discharge with two spaced apart electrodes located in a wellbore at a distance from the at least one porous zone, thereby propagating at least one shock wave;

fracturing said treatment zone with said at least one shock wave, thereby creating fractures;

introducing a chemical agent from an upper surface external of the wellbore to a chemical agent introducing unit located inside the wellbore within said treatment zone for increasing the permeability of said treatment zone; and wherein said chemical agent introducing unit comprises a plurality of acid flow channels operable to direct the chemical agent onto a wall of the wellbore.

2. The method according to claim 1, wherein the step of generating at least one electrical discharge is performed prior to the step of introducing the chemical agent.

3. The method according to claim 1, wherein the step of introducing a chemical agent is performed prior to the step of generating at least one electrical discharge.

4. The method according to claim 1, wherein the step of generating at least one electrical discharge and the step of introducing a chemical agent are performed simultaneously.

5. The method according to claim 1, wherein (i) the at least one shock wave propagates radially from the longitudinal axis of the wellbore, (ii) the chemical agent is introduced preferentially into the created fractures, or (iii) the at least one shock wave propagates radially from the longitudinal axis of the wellbore and the chemical agent is introduced preferentially into the created fractures.

6. The method according to claim 1, wherein the chemical agent comprises a composition comprising at least one of an acid, a miscible fluid or a polymer.

7. The method according to claim 6, wherein the chemical agent is an acid composition, which is introduced at a static pressure less than a fracture gradient pressure value of the subterranean formation.

8. The method according to claim 7, wherein the acid composition comprises a weak acid, which has a reaction rate with mineral constituents of the subterranean formation that is lower than a rate of diffusion of the weak acid through the subterranean formation.

9. The method according to claim 8, wherein at least 50% of the weak acid introduced with the acid composition remains when the weak acid is diffused into the subterranean formation by the propagation of the at least one shock wave.

10. The method according to claim 1, further comprising a membrane partially defining a chamber around the two spaced apart electrodes, wherein said at least one shock wave transmits through the membrane.

11. The method of claim 10, further comprising applying a foam or gel onto the wall of the wellbore to reduce an amount of the chemical agent that directly contacts the wall of the wellbore.

12. The method of claim 11, wherein the chemical agent introducing unit is located at an elevation above the two spaced apart electrodes.

13. A stimulating device for recovering hydrocarbons in a wellbore from at least one porous zone of a subterranean formation, said device comprising:

an electrical discharge generating unit comprising two spaced apart electrodes located in said wellbore configured for generating at least one electrical discharge at a distance from the at least one porous zone thereby propagating at least one shock wave fracturing a treatment zone near a wellbore area;

a chemical agent introducing unit configured for introducing a chemical agent and a gel within said treatment zone for increasing the permeability of said treatment zone;

wherein said chemical agent introducing unit comprises a plurality of acid flow channels operable to direct the chemical agent and the gel onto a wall of the wellbore.

14. The device according to claim 13, wherein the electrical discharge unit comprises a membrane delimiting partially a chamber which is at least partially filled with a shock wave transmitting liquid.

15. The device according to claim 14, wherein the membrane is made of fluorinated rubber or fluoroelastomer and has a relative deformation characteristic of at least 150%.

16. The device according to claim 13, wherein the electrical discharge generating unit and the chemical agent introducing unit are configured to work simultaneously.

17. The device according to claim 13, wherein the electrical discharge generating unit and the chemical agent introducing unit are configured to work in sequence.

18. A system for stimulating a treatment zone, said system comprising:

a wellbore, wherein an area around the wellbore is in fluid connection with a subterranean formation having at least one porous zone; and a stimulating device located within the wellbore for recovering hydrocarbons from the at least one porous zone, said stimulating device comprising an electrical discharge generating unit comprising two spaced apart electrodes configured for generating at least one electrical discharge in the wellbore at a distance from the at least one porous zone, thereby propagating at least one shock wave fracturing a treatment zone near the area around the wellbore, wherein the treatment zone is in fluid connection with the at least one porous zone of the subterranean formation, and a chemical agent introducing unit configured for introducing at least one chemical agent within the treatment zone thereby increasing permeability of the treatment zone, wherein said chemical agent introducing unit is located at an elevation above said electrical discharge generating unit.

19. The system of claim 18, wherein the at least one chemical agent is a weak acid and wherein at least 50% of the weak acid introduced within the treatment zone remains when the at least one shock wave is propagated.

* * * * *